US005785242A

United States Patent [19]

Lombardo

[11] Patent Number: 5,785,242

[45] Date of Patent: Jul. 28, 1998

[54] PRESSURE SEAL SPOT PATTERN FOR C-FOLD MAILER

[75] Inventor: Leo Lombardo, Manchester, N.H.

[73] Assignee: Moore Business Forms, Inc., Grand Island, N.Y.

[21] Appl. No.: 690,546

[22] Filed: Jul. 31, 1996

[51] Int. Cl.[6] ..... B65D 27/06

[52] U.S. Cl. ..... 229/305; 229/92.1

[58] Field of Search ..... 229/92.1, 92.3, 229/305

[56] References Cited

U.S. PATENT DOCUMENTS

| | | | |
|---|---|---|---|
| 3,837,565 | 9/1974 | Johnsen | 229/69 |
| 4,575,121 | 3/1986 | Conti | 229/92.3 |
| 4,706,878 | 11/1987 | Lubotta et al. | 229/92.3 |
| 5,174,491 | 12/1992 | Taylor | 229/92.1 |
| 5,201,464 | 4/1993 | File . | |
| 5,238,178 | 8/1993 | Hutchinson et al. | 229/92.1 |
| 5,294,041 | 3/1994 | Whiteside | 229/92.1 |
| 5,314,110 | 5/1994 | Lombardo | 229/92.1 |
| 5,346,123 | 9/1994 | Lombardo | 229/92.1 |
| 5,360,159 | 11/1994 | Perriman | 229/92.3 |
| 5,607,738 | 3/1997 | Bishop | 229/92.1 |

*Primary Examiner*—Stephen P. Garbe

*Attorney, Agent, or Firm*—Nixon & Vanderhye

[57] ABSTRACT

An intermediate for a C-fold mailer type business form is provided that does not cup or distort as a result of pressure sensitive cohesive provided on both the face and the back of the same panel. This improves the processing of the intermediate through cut sheet laser printers and post-processing equipment, and allows for easier stacking during manufacture. A sheet of paper having first and second faces and opposite parallel longitudinal edges has first and second transverse fold lines forming a sheet into three panels, and first and second longitudinal lines of weakness forming longitudinal marginal portions with the longitudinal edges. A first pattern (such as spaced quadrate cohesive elements) is formed in the marginal portions of the first face of the third panel while a second pattern of pressure cohesive elements is formed on the second face of the marginal portions of the third panel, the second pattern of elements staggered with respect to the first pattern so that cupping or distortion of the sheet at the third panel is substantially prevented. Other patterns of pressure cohesive formed on the marginal portions cooperate with the first and second panels to seal the longitudinal edges of the mailer, the other patterns typically also comprising spaced quadrate cohesive elements. A mailer is formed from the intermediate by C-folding the sheet about the first and second fold lines.

20 Claims, 4 Drawing Sheets

20
15
11
34
34
10
12
44
14
36
40
17
44
26
27
23
21
16
35
42
18

53
29
17
26
16
34
30
OUTGOING ADDRESS
52
27
11
36
35
28
18

PRESSURE SEAL SPOT PATTERN FOR C-FOLD MAILER

BACKGROUND AND SUMMARY OF THE INVENTION

Mailer type business forms constructed by C-folding a single paper sheet about fold lines have been popular for many years. These mailers offer the advantages of simplicity of construction, printing, and utilization. Particularly worthwhile are such C-fold mailers (with or without built in return envelopes) sold by Moore Business Forms, Inc. under the trademark SPEEDISEAL® which utilize pressure cohesive to hold the form panels together, such as shown—for a return envelope configuration—in U.S. Pat. No. 5,201,464 (the disclosure of which is hereby incorporated by reference herein).

The standard C-fold mailer using pressure cohesive includes a staggered pattern of a series of in-board and outboard cohesive patterns (such as strips) on the face and back of the form. The standard pattern was created so that the business form intermediates would not block or stick together. However because such forms have pressure sensitive cohesive on both the face and the back of the bottom panel there can be a significant problem when used with some conventional cut sheet laser printers. Sometimes a flexed edge—often referred to as cupping or distortion—is created on the bottom panel as a result of the cohesive patterns. This distortion can be so excessive that the intermediates cannot feed properly into cut sheet laser printers, or can jam in some printers. This problem can be compounded by the fact that it is desirable to provide such intermediates with different paper weights and constructed of different composition.

According to the present invention an intermediate for a C-fold mailer type business form, and a mailer type business form formed from the intermediate, are provided which substantially overcome the problem of cupping or distortion discussed above. The problem is solved according to the present invention by providing a different type of pressure cohesive pattern on the third panel (and cooperating other patterns are preferably provided on the other panels). By eliminating the cupping or distortion that can occur in conventional C-fold intermediates, according to the invention the processing of the intermediates through cut sheet lasers and post-processing equipment are significantly improved, as is the ease of production of the C-fold mailers themselves. The construction according to the invention also allows for easier stacking during manufacture. Despite the improvements provided according to the invention the pressure cohesive pattern provided according to the invention allows for proper sealing of the mailer so that it will not come apart during normal handling.

According to one aspect of the present invention an intermediate for a C-fold mailer type business form is provided comprising the following components: A sheet of paper having a first face adapted to provide the majority of the interior of the mailer when constructed, and a second face adapted to provide the majority of the exterior of the mailer when constructed. The sheet having first and second opposite parallel longitudinal edges extending the entire length thereof, and opposite first and second parallel end edges. First and second transverse fold lines formed in the sheet parallel to the opposite end edges, and defining the sheet into first, second, and third panels, the first panel between the first end edge and first fold line, and the third panel between the second fold line and the second end edge, the second panel between the first and third panels. First and second longitudinal lines of weakness formed in the sheet parallel to and adjacent, but transversely spaced from, the longitudinal edges, the lines of weakness defining, with the longitudinal edges, longitudinal marginal portions. A first pattern of longitudinally spaced pressure cohesive elements formed in the marginal portions on the first face of the sheet third panel. A second pattern of longitudinally spaced pressure cohesive elements formed in the marginal portions on the second face of the sheet third panel, the second pattern of elements staggered with respect to the first pattern of elements so that cupping or distortion of the sheet at the third panel is substantially prevented. And, other patterns of pressure cohesive formed on the marginal portions of the first face of the first and second panels for cooperating, respectively, with the second and first patterns, to seal the longitudinal edges of the mailer formed by C-folding the sheet about the first and second fold lines.

The other patterns of pressure cohesive set forth above preferably include a third pattern of longitudinally spaced pressure cohesive elements formed on the marginal portions of the second panel first face, the third and first pattern elements of approximately the same size and shape and longitudinally spaced approximately the same distance from each other and the second fold line so that they align and engage when the sheet is folded about the second fold line longitudinally spaced pressure cohesive elements formed on the marginal portions of the second panel first face, the third and first pattern elements of approximately the same size and shape and longitudinally spaced approximately the same distance from each other and the second fold line so that they align and engage when the sheet is folded about the second fold line. The other patterns also preferably include a fourth pattern of longitudinally spaced pressure cohesive elements formed on the marginal portions of the first panel first face, the second and fourth pattern elements of approximately the same size and shape and longitudinally spaced approximately the same distance from each other and the first fold line so that they align and engage when the sheet is C-folded about the first and second fold lines.

While the first through fourth pattern elements may have a wide variety of configurations such as circular or non-circular dots or spots, or various polygonal configurations, preferably they are quadrate. A particularly desirable dimensioning of such quadrate elements for conventional 8½×11 sheet sizes (or A4 sheet sizes) are about ⅛ inch×¼ inch, e.g. approximately 0.12×0.25 inches. These cohesive elements are also spaced approximately one-half inch apart in most areas, typically being spaced from each other a distance between about one and three times (e.g. spaced about 0.25–0.75 inches) greater than their maximum longitudinal dimension.

The intermediate according to the invention also may comprise a fifth pattern of pressure cohesive formed on the first face adjacent the first end edge, and a sixth pattern of pressure cohesive formed on the third panel second face adjacent and parallel to the second fold line, the fifth and sixth patterns of cohesive formed on the third panel second face adjacent and parallel to the second fold line, and the fifth and sixth patterns of cohesive positioned so that they are aligned and engage each other when the sheet is C-folded about the first and second fold lines. The intermediate may also comprise seventh and eighth patterns of pressure cohesive formed on the first face adjacent to and parallel to the second fold line and positioned on opposite sides of the fold lines so that the seventh and eighth patterns are aligned and engage each other when the sheet is folded about the second fold line. The eighth pattern is spaced from the second fold line a greater distance than is the sixth pattern so that the sixth and eighth patterns are not aligned with each other.

The first and second fold lines may be lines of weakness. The intermediate may also further comprise outgoing address indicia imaged on the first panel second face. A first transverse line of weakness may be disposed adjacent the first end edge, the sixth pattern of cohesive between the first transverse line of weakness and the first end edge; and second and third transverse lines of weakness may be disposed in the second and third panels, respectively, and parallel to and adjacent but spaced from the second fold line, the sixth, seventh, and eighth patterns of cohesive between the second and third transverse lines of weakness.

According to another aspect of the present invention a mailer type business form is provided. The business form comprises the following components: A top panel with top and bottom faces. A middle panel with top and bottom faces, the top face of the middle panel parallel to and adjacent the bottom face of the top panel. A bottom panel with top and bottom faces, the top face of the bottom panel parallel to and adjacent the bottom face of the middle panel. The middle panel having parallel end edges and connected to the top and bottom panels by the end edges. The top, middle and bottom panels having aligned longitudinal edges. A first pattern of spaced pressure cohesive elements formed on the middle panel top face adjacent the longitudinal edges thereof. A second pattern of spaced pressure cohesive elements formed on the middle panel bottom face adjacent the longitudinal edges thereof and staggered with respect to the first pattern of elements so that they are not aligned one above the other. And, other patterns of pressure cohesive formed on the bottom face of the first panel and the top face of the bottom panel adjacent the longitudinal edges of each so that they sealingly engage the second and first pattern cohesive elements to hold the mailer together.

An outgoing address is typically provided on the top panel top face while useful indicia is provided on the top and bottom faces of the middle panel and the top face of the bottom panel. The details of the pressure cohesive are preferably as described above with respect to the intermediate, and the end edges preferably are lines of weakness, and the first, second, and some other patterns of pressure cohesive are provided in longitudinal marginal portions separated from the main part of the panels by longitudinal lines of weakness.

It is the primary object of the present invention to provide an intermediate for a C-fold mailer, and the C-fold mailer so produced, which does not suffer from cupping or distortion so that it may be easily processed by cut sheet laser printers and post-processing equipment, and can stack in a simple manner during manufacture, yet provides pressure cohesive in such a manner that the mailers are properly sealed. This and other objects of the invention will become clear from an inspection of the detailed description of the invention and from the appended claims.

DETAILED DESCRIPTION OF THE DRAWINGS

Figure 1:
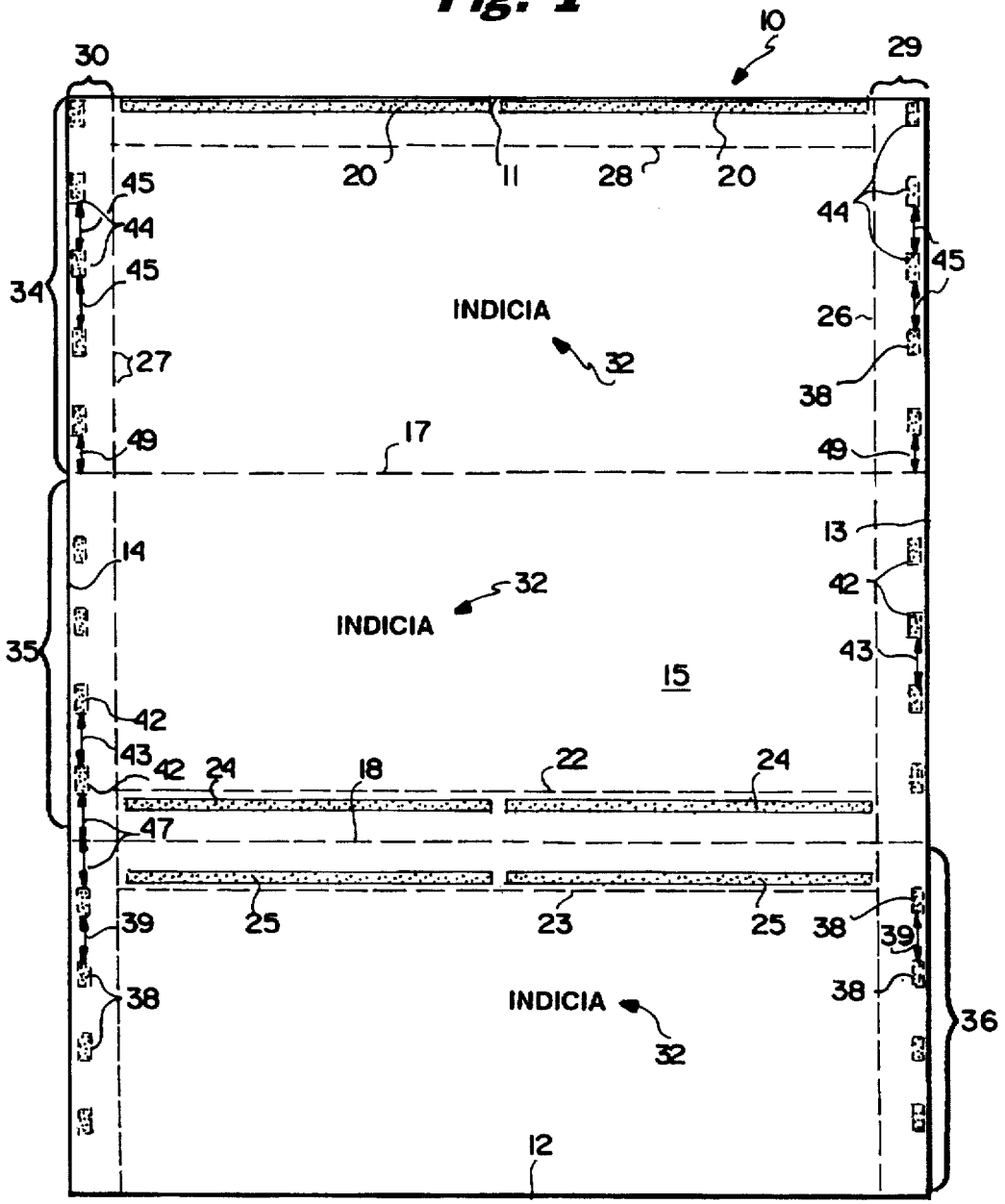
FIG. 1 is a top plan view of an exemplary intermediate for a C-fold mailer type business form according to the present invention.

An intermediate for a C-fold mailer type business form according to the present invention is shown in FIGS. 1 through 4. The intermediate comprises a sheet of paper 10 having opposite first and second parallel end edges 11, 12, first and second opposite parallel longitudinal edges 13, 14 (preferably substantially transverse to the edges 11, 12), and first and second faces 15, 16. The first face 15 is adapted to provide the majority of the interior of a mailer (see FIG. 5) constructed using the sheet 10, while the second face 16 is adapted to provide the majority of the exterior of the mailer when constructed (typically the entire exterior).

The sheet 10 also has first and second transverse fold lines 17, 18 parallel to the end edges 11, 12. The fold lines 17, 18 may be score lines, lines of weakness (such as perforation lines), or any other conventional construction that facilitates crisp folding. The sheet 10 may be formed of a wide variety of different weights and types (such as conventional bond, or paper with various amounts of post-consumer recycled content) of paper.

The sheet 10 may optionally provide strips 20 (see FIG. 1) of pressure cohesive along the edge 11 adapted to cooperate with strips 21 (see FIG. 2) on the face 16 adjacent the second fold line 18. The pressure cohesive for the strips 20, 21—and for all the pressure cohesive patterns and elements hereafter described—is preferably of the type used in the conventional Moore SPEEDISEAL® mailers, and described in detail in U.S. Pat. No. 5,201,464 (the disclosure of which is hereby incorporated by reference herein), or the other pressure cohesives described in that patent.

Figure 2:
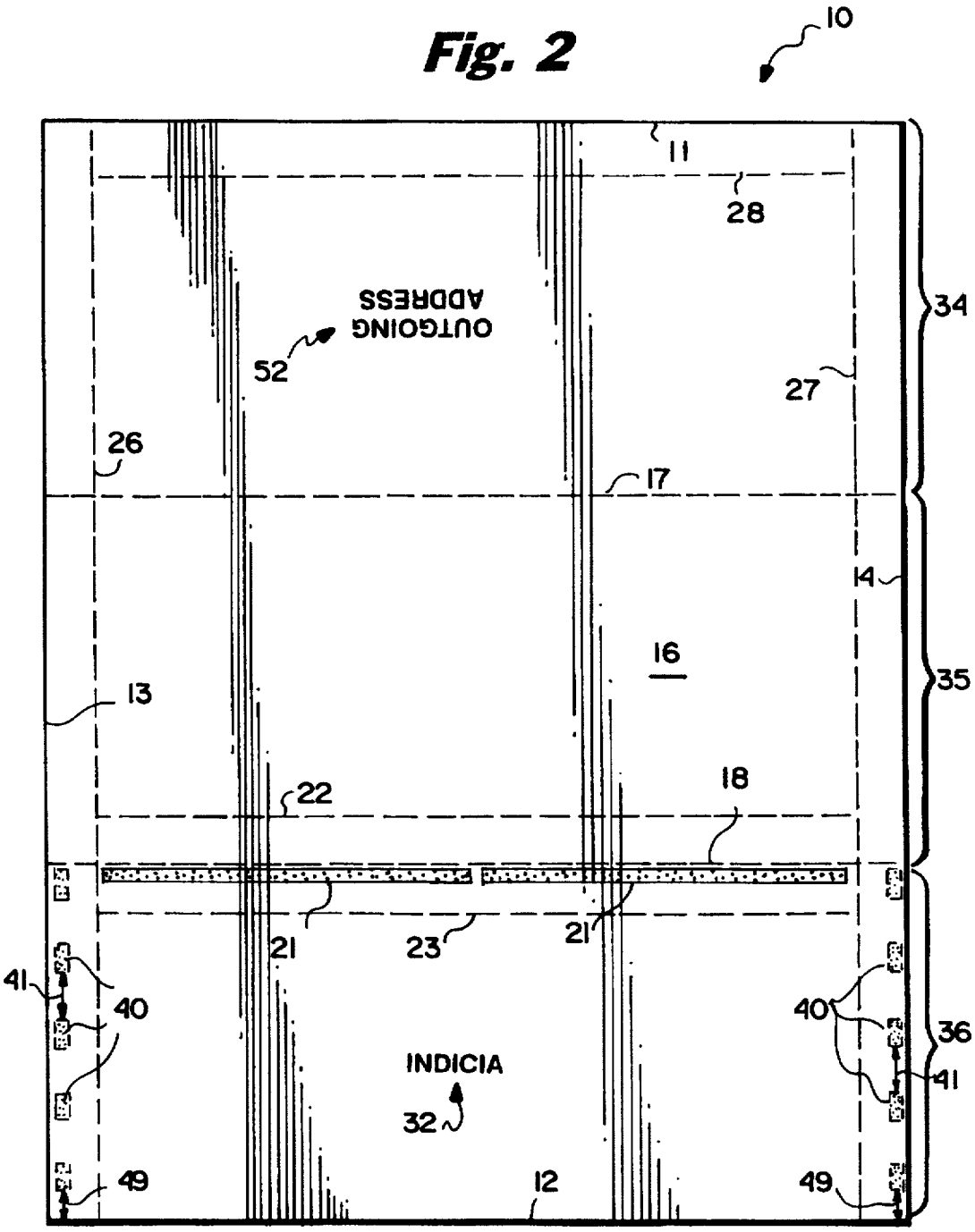
FIG. 2 is a bottom plan view of the intermediate of FIG. 1.

The sheet 10 may also comprise optional longitudinal lines of weakness 22, 23 parallel to and adjacent, but spaced from, the second fold line 18, and the strips of cohesive 24, 25 which are formed on the first face 15 between the lines of weakness 22, 23 and on opposite sides of the fold line 18, the strips 24, 25 cooperating with each other when the sheet 10 is C-folded about fold line 18, and the strips 25 being staggered with respect to the strips 21 so that they are not on exactly opposite portions of the sheet 10 (compare FIGS. 1 and 2).

The sheet 10 also comprises first and second longitudinal lines of weakness 26, 27 parallel to and adjacent, but transversely spaced from, the longitudinal edges 13, 14, respectively, the lines of weakness 26, 27 defining—with the longitudinal edges 13, 14—longitudinal marginal portions 29, 30. The lines of weakness 26, 27 are preferably perforation lines but may comprise any conventional lines of weakness.

The sheet 10 also preferably comprises the optional transverse line of weakness 28 which is parallel to and adjacent but spaced from the edge 11, on the opposite side of the edge 11 from the strips 20. Indicia 32 may be imaged where indicated on both of the faces 15, 16, the indicia 32 either being non-variable indicia that may be imaged commonly on all of the sheets 10 produced, or non-variable indicia in conjunction with variable indicia imaged by a laser printer or the like through which the sheet 10 is passed during production of a mailer. If the laser printer is a simplex printer the indicia 32 will typically be imaged only on the face 15, whereas if it is a duplex printer variable indicia 32 may also be imaged on the face 16 as indicated in FIG. 2.

Figure 3:
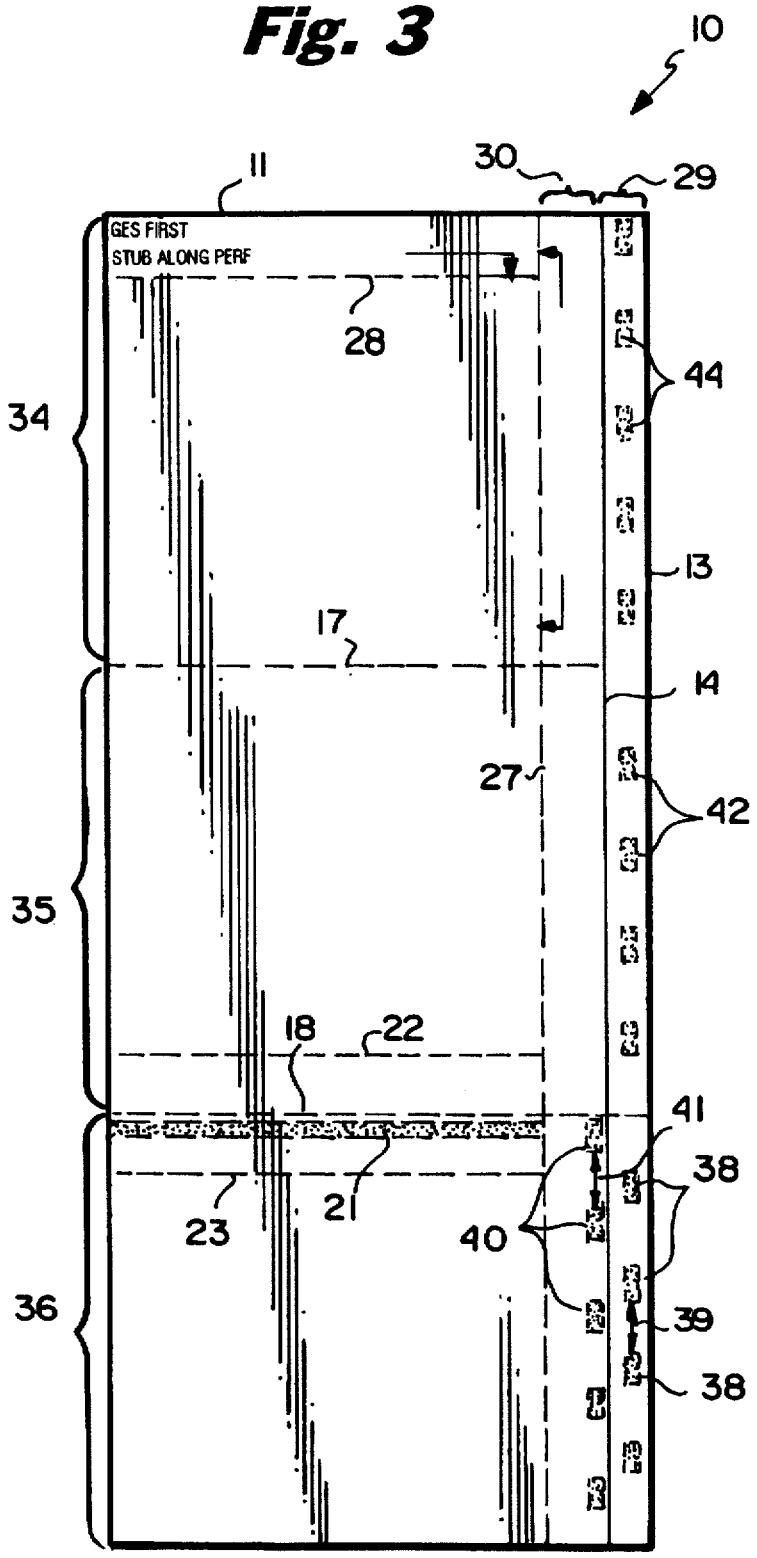
FIG. 3 is a plan view showing the intermediate of FIGS. 1 and 2 folded about a longitudinal axis to show the staggered configuration of the pressure cohesive element in the third panel of the intermediate.

As seen in FIGS. 2 and 3, the fold lines 17, 18 divide the sheet 10 into first, second, and third panels 34–36, respectively, the first panel between the edge 11 and first fold line 17, the second panel 35 between the fold lines 17, 18, and the third panel 36 between the second fold line 18 and the second end edge 12.

What has been heretofore described is basically conventional in C-fold SPEEDISEAL® intermediates for producing C-fold mailers. According to the present invention particular pressure cohesive elements are provided in the marginal portions 29, 30 which have the advantages of substantially eliminating cupping or distortion of the sheet 10 so as to improve processing of the sheet 10 through cut sheet lasers and post-processing equipment, while allowing for easier stacking of the sheets 10 during manufacture, while still providing a proper seal in the mailer produced.

According to the present invention a first pattern of longitudinally spaced pressure cohesive elements 38 (see FIG. 1) are formed in the marginal portions 29, 30 on the first face 15 of the third panel 36. The elements 38 are spaced longitudinally preferably a substantially uniform distance 39. The sheet 10 also includes a second pattern of longitudinally spaced pressure cohesive elements 40 (see FIG. 2) formed in the marginal portions 29, 30 on the second face 16 of the sheet third panel 36, the elements 40 longitudinally spaced from each other a substantially uniform distance 41. As most easily seen in FIG. 3, the elements 40 are staggered with respect to the elements 38 so that the sheet 10 does not have cohesive on the same part of the sheet on opposite faces, so that cupping or distortion of the sheet 10 at the third panel 36 is substantially prevented.

The sheet 10 also includes other patterns of pressure cohesive formed on the marginal portions 29, 30 of the first face 15 of the first and second panels 34, 35 for cooperating, respectively, with the second and first panel elements 40, 38, respectively, to seal the longitudinal edges 13, 14 of the mailer (see FIG. 5) formed by C-folding the sheet 10 about the fold lines 17, 18. These other patterns may comprise strips or a wide variety of other configurations, but preferably—as illustrated in FIG. 1—include a third pattern of longitudinally spaced pressure cohesive elements 42 formed in the marginal portions 29, 30 of the second panel 35 first face 15, the elements 42 longitudinally spaced a distance 43. The elements 42, and the spacings 43, are of approximately the same size and shape and dimension as the elements 38 and their spacings 39, so that the elements 38, 42 align and engage when the sheet 10 is folded about the second fold line 18.

The other patterns also preferably include a fourth pattern of longitudinally spaced pressure cohesive elements 44 formed on the marginal portions 29, 30 of the first panel 34 first face 15. The fourth pattern elements 44 are of approximately the same size and shape as the second pattern elements 40, and the spacings 45, 41 are substantially the same, so that the elements 40, 44 align and engage when the sheet 10 is C-folded about the fold lines 17, 18, as illustrated schematically in FIG. 4.

While the elements 38, 40, 42, 44 may have a wide variety of configurations including circular dots or spots, non-circular dots or spots, polygonal shaped elements, and the like, or even irregular shapes, preferably they are quadrate in configuration (either square ore rectangular, preferably rectangular) as illustrated in the drawing, and have a maximum longitudinal dimension, which maximum longitudinal dimension is typically greater than the transverse dimension thereof. For example for the elements 38, 40, 42, 44 illustrated in the drawings, a typical size would be approximately 0.12 (the transverse dimension) by approximately 0.25 (the longitudinal dimension) inches.

The spacings 39, 41, 43, 45 are typically at least as great as the longitudinal dimensions of the elements 38, 40, 42, 44. That is the longitudinal spacings 39, 41, 43, 45 are preferably between about one and three times greater than the maximum longitudinal dimension of the elements 38, 40, 42, 44. Preferably they are about twice as large, e.g. about 0.5 inches for the preferred dimensions of the elements 38, 40, 42, 44 described above. Note also that the dimensions of the elements 38, 42 may be different than the dimensions of the element 40, 44, although for ease of construction they preferably are the same. The elements 38, 40, 42, and 44 are typically applied using conventional spot coating techniques.

In order to provide proper alignment of the elements 38, 42, as seen in FIG. 1 the closest elements 38, 42 to each other are spaced the same longitudinal distance 47 from the second fold line 18. As seen in FIGS. 1 and 2, in order to provide proper alignment of the elements 40, 44, the elements 40 closest to the edge 12 are spaced the same longitudinal distance 49 as the closest elements 44 to the first fold line 17.

Note that all of the elements 38, 40, 42, 44 associated with the marginal portion 30 may have different configurations and spacings than the same elements associated with the marginal portion 29 as long as the elements within any marginal portion 29, 30 properly align. However for ease of construction it is preferred that the elements within the margins 29, 30 be of the same size and spacings, including the spacings 47, 49.

Figure 5:
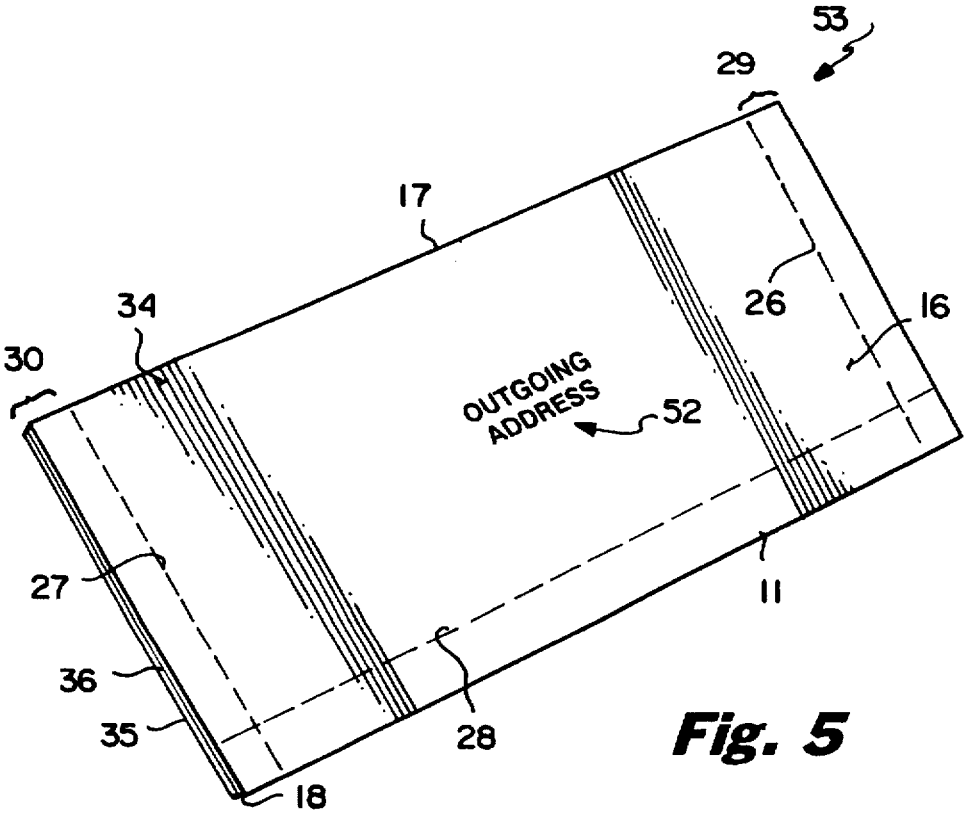
FIG. 5 is a top perspective view of a C-folded mailer according to the present invention produced from the intermediate of FIGS. 1 through 4.

As seen in FIGS. 2 and 5, the sheet 10 typically has outgoing address indicia 52 imaged on the second face 16 of the first panel 34. This outgoing address indicia 52 is typically variable indicia imaged by a laser printer or the like and it may have either the orientation illustrated in FIGS. 2 and 5, or be "upside down" with respect to what is illustrated in FIGS. 2 and 5. Alternatively this outgoing address indicia 52 may be provided by a label that is applied on to the face 16 of the first panel 34, or it may be impact printed thereon after the mailer 53—see FIG. 5—has been formed.

Figure 4:
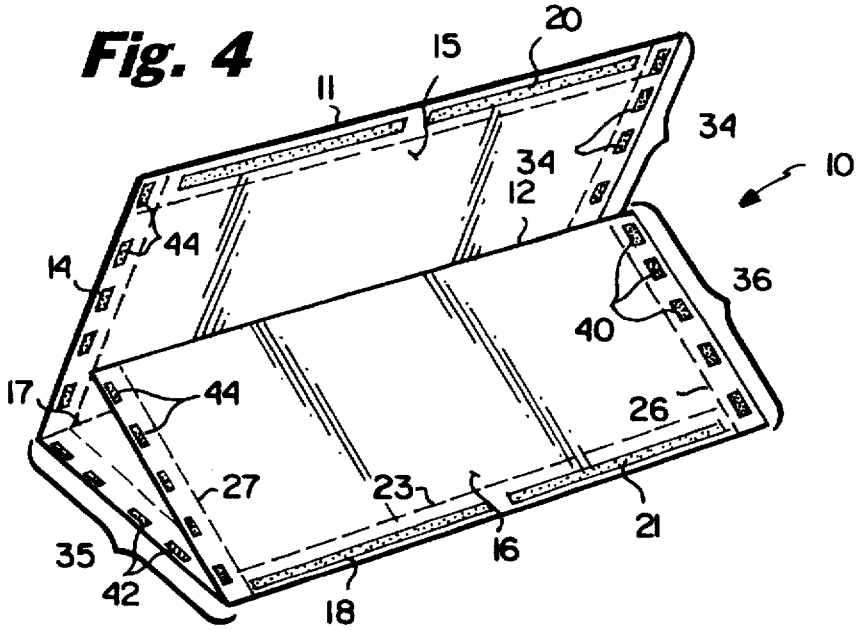
FIG. 4 is a top perspective view showing the folding of the intermediate of FIGS. 1 through 3 about the fold lines to form a mailer.

In a typical utilization of the sheet 10, it is passed through a laser printer or the like so that at least some of the indicia 32 and/or outgoing address 52 are imaged thereon, then is passed to conventional SPEEDISEAL® pressure sealing equipment, which first C-folds the sheet 10 about the fold lines 17, 18 as illustrated in FIG. 4, and then seals the cohesive strips and elements 20, 21, 24, 25, 38, 40, 42, and 44 typically by applying pressure only in alignment with the cohesive strips or elements and not over the entire width and length of the form.

The mailer 53 so produced has the same three panels 34–36 as the sheet 10, only they are rearranged. That is the mailer 53 has a top panel, formed by the first panel 34, with top and bottom faces, the top face formed by the face 16 of the panel 34 of the intermediate, and the bottom face formed by the face 15 of the panel 34 of the intermediate. The mailer 53 has a middle panel 36 which was the third panel of the intermediate, having a top face which was the face 16 of the intermediate panel 36, and a bottom face which was the face 15 of the intermediate panel 36. The top face of the middle panel is parallel to and adjacent the bottom face of the top panel. The mailer 53 further comprises a bottom panel, which was the second panel 35 of the intermediate. The top face of the bottom panel 35 is the first face 15 of what was the intermediate, while the bottom face of the panel 35 is the face 16 of what was the intermediate. The top face of the bottom panel is parallel to and adjacent the bottom face of the middle panel. The middle panel 36 also has parallel end edges which are connected to the top and bottom panels 34, 35. These connections are what were the fold lines 17, 18 of the intermediate.

In the mailer 53 the lines of weakness 22, 23 and 28 (if these lines of weakness are provided) are in alignment with each other, as are the lines of weakness 26, 27 and the various panels 34–36. To open the mailer 53 one tears first along the lines of weakness 26, 27 to separate the marginal portions 29, 30, and then—if they are provided—along the lines of weakness 22, 23, 28 to provide two sheets of paper, one being that portion of the intermediate panel 36 bordered by the lines 23, 26, and 27 and the edge 12, and the other being that part of the panels 34, 35 bordered by the lines 22 and 26–28.

While the simple construction illustrated in the drawings is preferred, the C-fold intermediate and mailer according to the present invention also may have provision for inserts to be provided when the mailer is being formed as illustrated in FIG. 4, and also may provide cohesive strips for forming a return envelope, such as disclosed in U.S. Pat. No. 5,201,464 [that is different cohesive strips or other patterns and different lines of weakness being provided than are described above with respect to the optional strips or lines 20 through 25 and 28].

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and products.

What is claimed is:

1. An intermediate for a C-fold mailer type business form comprising:

a cut sheet of paper having a first face adapted to provide the majority of the interior of the mailer when constructed, and a second face adapted to provide the majority of the exterior of the mailer when constructed;

said sheet having first and second opposite parallel longitudinal edges extending the entire length thereof, and opposite first and second parallel end edges;

first and second transverse fold lines formed in said sheet parallel to said opposite end edges, and defining said sheet into first, second, and third panels, said first panel between said first end edge and first fold line, and said third panel between said second fold line and said second end edge, said second panel between said first and third panels;

first and second longitudinal lines of weakness formed in said sheet parallel to and adjacent, but transversely spaced from, said longitudinal edges, said lines of weakness defining, with said longitudinal edges, longitudinal marginal portions;

a first pattern of longitudinally spaced pressure cohesive elements formed in said marginal portions on said first face of said sheet third panel;

a second pattern of longitudinally spaced pressure cohesive elements formed in said marginal portions on said second face of said sheet third panel, said second pattern of elements staggered with respect to said first pattern of elements so that cupping or distortion of said sheet at said third panel is substantially prevented; and other patterns of pressure cohesive formed on said marginal portions of said first face of said first and second panels for cooperating, respectively, with said second and first patterns, to seal the longitudinal edges of the mailer formed by C-folding said sheet about said first and second fold lines.

2. An intermediate as recited in claim 1 wherein said other patterns include a third pattern of longitudinally spaced pressure cohesive elements formed on said marginal portions of said second panel first face, said third and first pattern elements of approximately the same size and shape and longitudinally spaced approximately the same distance from each other and said second fold line so that they align and engage when said sheet is folded about said second fold line.

3. An intermediate as recited in claim 2 wherein said other patterns include a fourth pattern of longitudinally spaced pressure cohesive elements formed on said marginal portions of said first panel first face, said second and fourth pattern elements of approximately the same size and shape and longitudinally spaced approximately the same distance from each other and said first fold line so that they align and engage when said sheet is C-folded about said first and second fold lines.

4. An intermediate as recited in claim 3 wherein said first, second, third and fourth pattern elements are quadrate cohesive elements.

5. An intermediate as recited in claim 4 wherein said first, second, third, and fourth pattern cohesive elements each have dimensions that are approximately 0.12×0.25 inches.

6. An intermediate as recited in claim 5 wherein said first, second, third, and fourth pattern elements each have as the longitudinal dimension thereof about 0.25 inches, and are longitudinally spaced from each other a distance between about 0.25–0.75 inches.

7. An intermediate as recited in claim 3 wherein said first, second, third and fourth pattern elements each have a maximum longitudinal dimension, and are longitudinally spaced from each other a distance between about one and three times greater than their maximum longitudinal dimension.

8. An intermediate as recited in claim 1 wherein said other patterns include a fourth pattern of longitudinally spaced pressure cohesive elements formed on said marginal portions of said first panel first face, said second and fourth pattern elements of approximately the same size and shape and longitudinally spaced approximately the same distance from each other and said first fold line so that they align and engage when said sheet is C-folded about said first and second fold lines.

9. An intermediate as recited in claim 1 further comprising a fifth pattern of pressure cohesive formed on said first face adjacent said first end edge, and a sixth pattern of pressure cohesive formed on said third panel second face adjacent and parallel to said second fold line, said fifth and sixth patterns of cohesive formed on said third panel second face adjacent and parallel to said second fold line, said fifth and sixth patterns of cohesive positioned so that they are aligned and engage each other when said sheet is C-folded about said first and second fold lines.

10. An intermediate as recited in claim 9 further comprising seventh and eighth patterns of pressure cohesive formed on said first face adjacent to and parallel to said second fold line and positioned on opposite sides of said fold lines so that said seventh and eighth patterns are aligned and engage each other when said sheet is folded about said second fold line.

11. An intermediate as recited in claim 10 wherein said eighth pattern is spaced from said second fold line a greater distance than is said sixth pattern so that said sixth and eighth patterns are not aligned with each other.

12. An intermediate as recited in claim 1 wherein said first and second fold lines are lines of weakness.

13. An intermediate as recited in claim 3 further comprising outgoing address indicia imaged on said first panel second face.

14. An intermediate as recited in claim 11 further comprising a first transverse line of weakness disposed adjacent said first end edge, said sixth pattern of cohesive between said first transverse line of weakness and said first end edge; and second and third transverse lines of weakness disposed in said second and third panels, respectively, and parallel to and adjacent but spaced from said second fold line, said sixth, seventh, and eighth patterns of cohesive between said second and third transverse lines of weakness.

15. A mailer type business form comprising:

a top panel with top and bottom faces;

a middle panel with top and bottom faces, said top face of said middle panel parallel to and adjacent said bottom face of said top panel;

a bottom panel with top and bottom faces, said top face of said bottom panel parallel to and adjacent said bottom face of said middle panel;

said middle panel having parallel end edges and connected to said top and bottom panels by said end edges;

said top, middle and bottom panels having aligned longitudinal edges;

a first pattern of spaced pressure cohesive elements formed on said middle panel top face adjacent said longitudinal edges thereof;

a second pattern of spaced pressure cohesive elements formed on said middle panel bottom face adjacent said longitudinal edges thereof and staggered with respect to said first pattern of elements so that they are not aligned one above the other;

other patterns of pressure cohesive formed on said bottom face of said first panel and said top face of said bottom panel adjacent said longitudinal edges of each so that they sealingly engage said second and first pattern cohesive elements to hold said mailer together; and wherein said first and second pattern elements are quadrate cohesive elements each having dimensions that are approximately 0.12×0.25 inches.

16. A mailer as recited in claim 15 further comprising outgoing address indicia on said top panel top face.

17. A mailer as recited in claim 15 wherein said approximately 0.25 inches dimension of said first and second pattern elements is a maximum longitudinal dimension, and wherein said first and second elements are longitudinally spaced from each other a distance about twice their maximum longitudinal dimension.

18. A mailer as recited in claim 15 wherein said other patterns of pressure cohesive are third and fourth, respectively, patterns of longitudinally spaced pressure cohesive elements of approximately the same size and shape and longitudinally spaced approximately the same distance from each other so that they are aligned with and sealingly engage said first and second pattern cohesive elements to hold said mailer together; and further comprising still other patterns of pressure cohesive formed on said panel to further hold said mailer together.

19. An intermediate as recited in claim 1 wherein said first and second patterns are quadrate cohesive elements each having a longitudinal dimension of approximately 0.25 inches and a transverse dimension of approximately 0.15 inches.

20. An intermediate as recited in claim 19 wherein said first and second elements are each longitudinally spaced from each other between about 0.5 inches.

* * * * *